US012383788B2

(12) United States Patent
Choobin

(10) Patent No.: US 12,383,788 B2
(45) Date of Patent: Aug. 12, 2025

(54) FOOT EXERCISING APPARATUS

(71) Applicant: Brad Barsam Choobin, Irvine, CA (US)

(72) Inventor: Brad Barsam Choobin, Irvine, CA (US)

( * ) Notice: Subject to any disclaimer, the term of this patent is extended or adjusted under 35 U.S.C. 154(b) by 152 days.

(21) Appl. No.: 18/349,028

(22) Filed: Jul. 7, 2023

(65) Prior Publication Data

US 2024/0058646 A1 Feb. 22, 2024

Related U.S. Application Data

(60) Provisional application No. 63/399,703, filed on Aug. 21, 2022.

(51) Int. Cl.
*A63B 23/08* (2006.01)
*A63B 21/00* (2006.01)
*A63B 21/008* (2006.01)

(52) U.S. Cl.
CPC ..... *A63B 23/08* (2013.01); *A63B 21/0088* (2013.01); *A63B 21/4015* (2015.10); *A63B 2225/62* (2013.01)

(58) Field of Classification Search
CPC ..... A63B 21/0888; A63B 21/4015; A63B 23/03508; A63B 23/03525; A63B 23/08; A63B 24/0087; A63B 2024/0093; A63B 2208/053; A63B 2209/00; A63B 2210/50; A63B 2220/56; A63B 2225/62
See application file for complete search history.

(56) References Cited

U.S. PATENT DOCUMENTS 5,425,742 A * 6/1995 Joy ..... A61H 35/00 601/152
5,868,690 A * 2/1999 Eischen, Sr. ..... A61H 9/0078 128/DIG. 20
5,891,065 A * 4/1999 Cariapa ..... A61H 9/0078 601/149
6,632,188 B2 * 10/2003 Thomas ..... A61H 9/0078 601/152
7,189,193 B2 * 3/2007 Egger ..... A63B 22/0605 482/57
7,717,869 B2 * 5/2010 Eischen, Sr. ..... A61H 9/0078 601/152
7,850,629 B2 * 12/2010 Ravikumar ..... A61H 7/001 602/5
8,075,506 B2 * 12/2011 Linares ..... A61F 13/046 602/14

(Continued)

*Primary Examiner* — Joshua Lee
(74) *Attorney, Agent, or Firm* — Barry Choobin; Patent 360

(57) ABSTRACT

An apparatus for foot exercise for strengthening at least the ankle and muscles around the ankle. The apparatus includes a housing having a cutout in a top wall thereof for allowing a foot of a user to pass through. A sleeve of a socks shape, hangs from the cutout, and the sleeve can receive at least the foot up to the ankle of the user. Multiple inflatable bags are disposed within the housing and around the sleeve, such that the inflatable bags, when inflated, resist movement of the foot received within the sleeve. The user can insert the foot into the sleeve; upon inserting the foot, inflates the plurality of inflatable bags; and upon inflating, moves the foot against the resistance offered by the inflated plurality of inflatable bags.

13 Claims, 3 Drawing Sheets

(56) References Cited

U.S. PATENT DOCUMENTS

| | | | | |
|---|---|---|---|---|
| 8,840,572 | B2 * | 9/2014 | Whalen | A61G 10/023 601/6 |
| 10,258,102 | B2 * | 4/2019 | Hsu | A43B 7/085 |
| 10,940,075 | B2 * | 3/2021 | Elderstiern | A61H 9/0078 |
| 11,259,985 | B2 * | 3/2022 | Elderstiern | A61H 9/0007 |
| 11,872,433 | B2 * | 1/2024 | Whalen | A63B 22/02 |
| 2007/0088238 | A1 * | 4/2007 | Tseng | A61H 9/0071 601/151 |

* cited by examiner

FOOT EXERCISING APPARATUS

CROSS-REFERENCE TO RELATED APPLICATIONS

This application claims priority from a U.S. Provisional Patent Application Ser. No. 63/399,703, filed on Aug. 21, 2022, the disclosure of which is incorporated herein by reference in their entirety.

FIELD OF INVENTION

The present invention relates to a foot exercising machine, and more particularly, the present invention relates to an apparatus for exercising the ankle and muscles around the ankle.

BACKGROUND

Exercise machines are quite popular for different types of physical exercises. An exercise machine typically provides resistance to a body movement resulting in the strength building of the respective muscles. Most of the exercise machines, currently available, typically target body areas including the leg, arms, chest, and abdomen. Very few exercise machines target the feet, and the users rely on physical exercises. This results in a lot of ankle-related injuries.

A need is therefore appreciated for a novel apparatus for exercising the ankle and associated muscles. A need is there for a safe and effective foot exercise machine.

SUMMARY OF THE INVENTION

The following presents a simplified summary of one or more embodiments of the present invention to provide a basic understanding of such embodiments. This summary is not an extensive overview of all contemplated embodiments and is intended to neither identify critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to an apparatus for exercising the foot, and in particular the ankle.

It is another object of the present invention that the apparatus guides the movement of the foot for safe exercise.

It is still another object of the present invention that the amount of resistance to foot's movement can be varied.

It is yet another object of the present invention that the apparatus is economical to manufacture.

It is an additional object of the present invention that the apparatus is compact.

It is still an additional object of the present invention that the resistance can be selectively varied for different foot movements.

It is yet an additional object of the present invention that one or both feet can be exercised.

In one aspect, disclosed is an apparatus for foot exercise, the apparatus comprises a housing having a bottom wall, a top wall, and sidewalls; a cutout in the top wall of the housing, the cutout configured to allow a foot of a user to pass through; a sleeve of a socks profile, the sleeve has an opening for receiving the foot of the user, the sleeve is of a dimension such that to receive at least the foot up to an ankle of the user, a periphery of the opening of the sleeve is coupled to a periphery of the cutout in the top wall; and a plurality of inflatable bags disposed within the housing and around the sleeve, the plurality of inflatable bags, when inflated, are configured to resist movement of the foot received within the sleeve.

In one aspect, the apparatus further comprises an inflation member configured to inflate the plurality of inflatable bags.

In one aspect, the apparatus further comprises a control unit operably coupled to the inflation member to control an amount of inflation of the plurality of inflatable bags.

In one aspect, the apparatus further comprises wheels coupled to a bottom of the housing.

In one aspect, the plurality of inflatable bags are configured to resist movement in left, right, front, rear, top, and bottom of the foot.

BRIEF DESCRIPTION OF THE DRAWINGS

The accompanying figures, which are incorporated herein, form part of the specification and illustrate embodiments of the present invention. Together with the description, the figures further explain the principles of the present invention and enable a person skilled in the relevant arts to make and use the invention.

DETAILED DESCRIPTION

Figure 1:
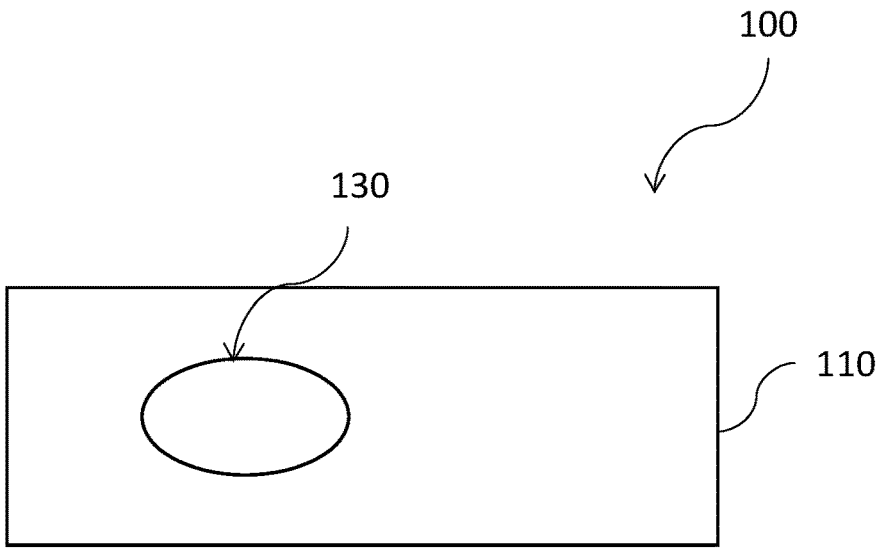
FIG. 1 is a top view of an apparatus for foot exercise, according to an exemplary embodiment of the present invention.
Figure 2:
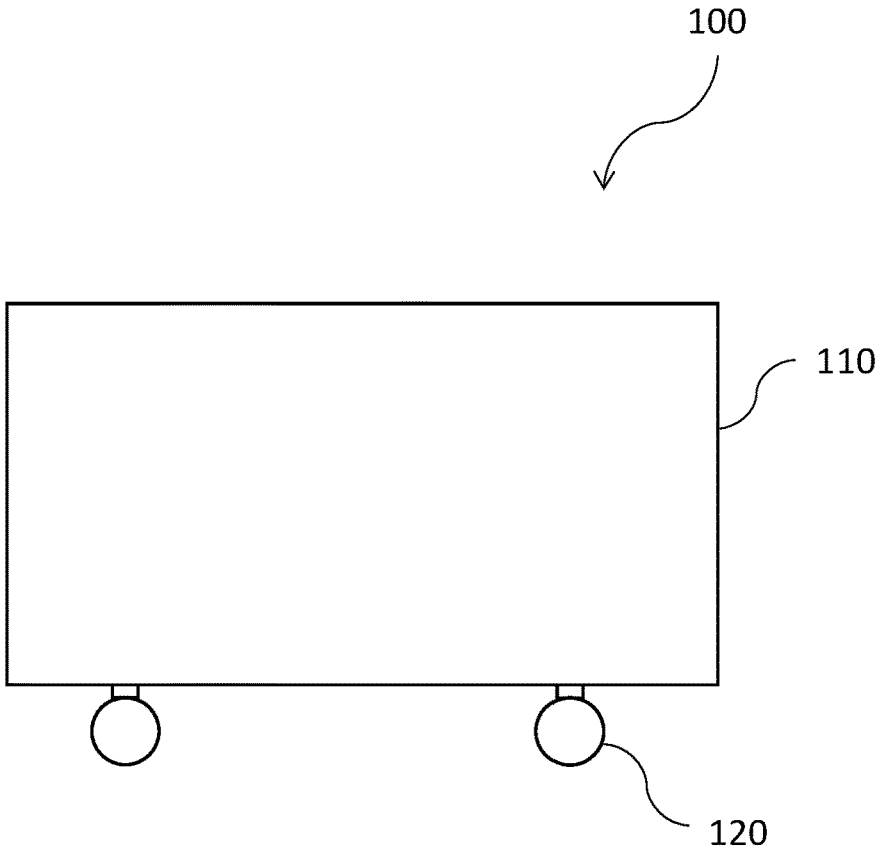
FIG. 2 is a side view of the apparatus showing the housing and the wheels, according to an exemplary embodiment of the present invention.
Figure 3:
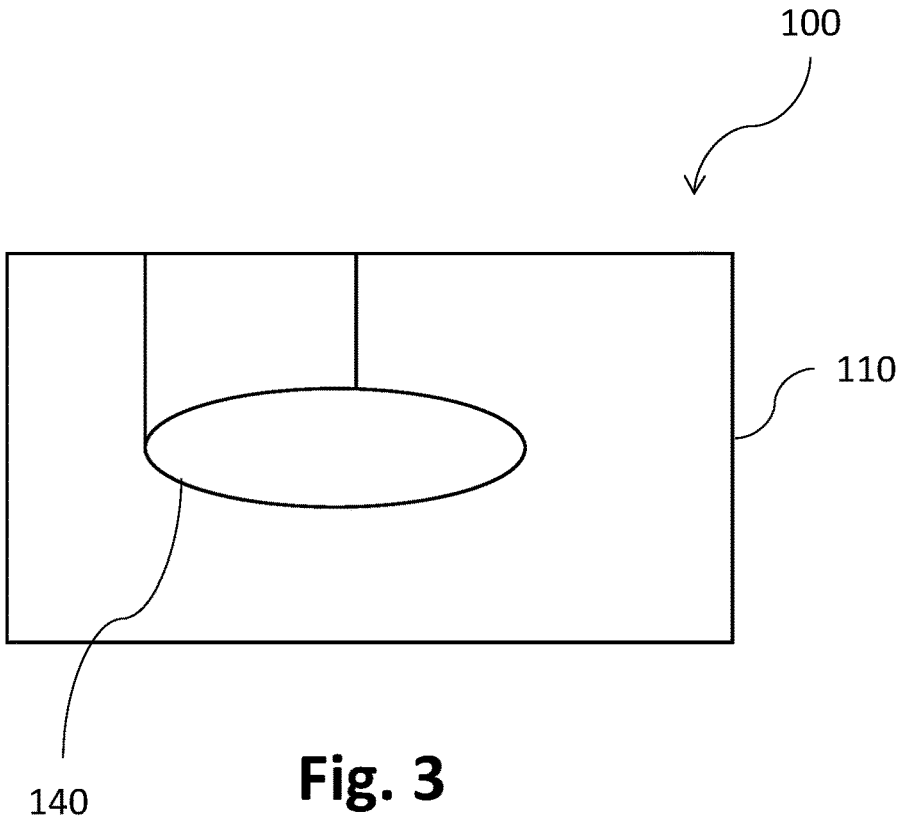
FIG. 3 is a sectional view showing the sleeve of the apparatus, according to an exemplary embodiment of the present invention.
Figure 4:
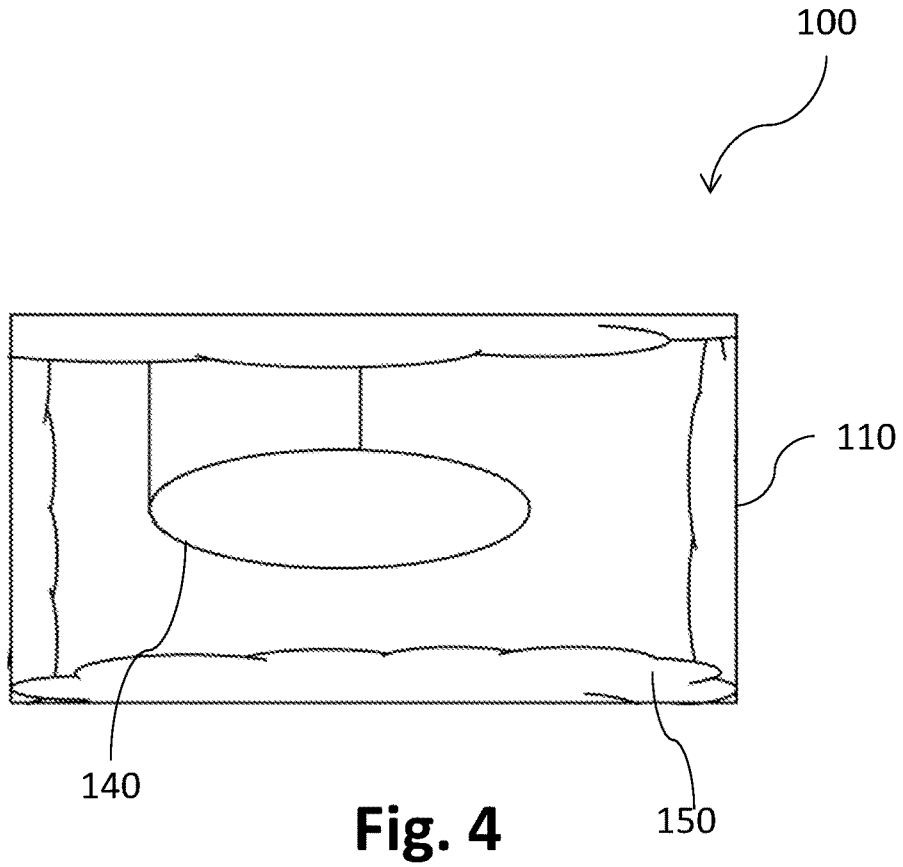
FIG. 4 is a sectional view showing the inflatable bags within the housing around the sleeve of the apparatus, according to an exemplary embodiment of the present invention.

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, the reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is to describe particular embodiments only and is not intended to be limiting of embodiments of the invention. As used herein, the singular forms "a", "an", and "the" are intended to include the plural forms as well, unless the context indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent.

Disclosed is an apparatus for a convenient and safer way of strengthening the ankle and the muscles surrounding the ankle. The disclosed apparatus targets the ankles and muscles around the ankle for strength building. The amount of resistance to the movement of the foot can be controlled and guided, thus providing a versatile and safe exercise apparatus. The disclosed apparatus can be compact and portable, thus easy to use and carry. The apparatus can be designed to accommodate a single foot or both feet. It is, however, obvious that two apparatus units, each designed for a single foot, can be used to simultaneously exercise both feet. The disclosed apparatus allows for free movement of the foot in any possible direction, thus can effectively target more than one area of the ankle and the associated muscles. Disclosed is an apparatus for effective and targeted workout and strength building of the ankle and associated muscles of the ankle.

Referring to FIGS. 1-4 which show different embodiments of the disclosed apparatus for foot workout. The disclosed apparatus 100 can have a housing 110 as shown in the drawings. The housing encases the components of the disclosed apparatus. The housing can be of a box profile i.e., cube or cuboid in shape; however, any shape of the housing is within the scope of the present invention. The housing can be made from a sturdy material that can withstand the force from the inflating bags inside the housing. Preferably, the material of the housing can be light in weight so that the overall weight of the apparatus can be less, and the apparatus is portable. In certain implementations, the housing can be made from plastic or Aluminum. Shown in FIG. 2, which is a side view of the apparatus; the apparatus may also be provided with wheels 120 that allow moving the apparatus on the floor easily and comfortably. Four such wheels can be provided at four corners of the bottom of the housing. For example, caster wheels can be used that can be mounted to the bottom of the housing. Not shown in the drawings, a long handle can also be provided, that can be grabbed in a hand for moving the disclosed apparatus.

On top of the housing, shown in FIG. 1, there can be a cutout 130 in a wall of the housing. Through this cutout 130, a foot can be inserted into the housing for a workout. The cutout can be of an elongated oval shape so that the foot can be inserted comfortably. It is to be noted, however, that the shape and size of this cutout at the top of the housing can be varied for optimizing the foot entry and any such change or modification is within the scope of the present invention.

The apparatus further includes a sleeve 140 for receiving the foot of the user. The sleeve can be of a socks-like profile that can accommodate the foot of the user. The sleeve has an opening through which the foot can be inserted into the sleeve. The periphery of the opening of the sleeve can be mounted along the periphery of the cutout in the top wall of the housing. The opening of the sleeve can line and extend along the periphery of the cutout. The sleeve opening portion can provide cushioning to the cutout so that the cutout portion of the housing does not pinch against the leg of the user while working out. Additional cushioning can also be added along the inner periphery of the cutout, such that the additional cushioning can be sandwiched between the cutout portion and the sleeve portion. The sleeve hangs from the top wall of the housing and the user can insert their foot into the sleeve through the cutout in the top of the housing. The depth of the sleeve can be such that the lower sheen of the leg of the user may rest against the cutout portion of the housing.

Figure 5:
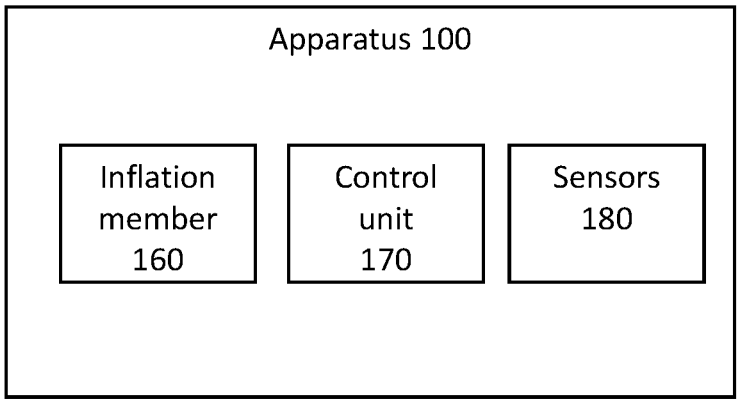
FIG. 5 is a block diagram of the apparatus, according to an exemplary embodiment of the present invention.

The apparatus further includes inflatable bags 150 mounted within the housing and around the sleeve. The apparatus further includes an inflation member for inflating the inflatable bags. FIG. 5, which is a block diagram shows the inflation member 160. In a preferred embodiment, each inflatable bag can be independently filled with air, wherein the amount of filling can be controlled, thus controlling the pressure or resistance created by the individual inflated bag. It is understood, however, that two or more airbags can be inflated through a common inflation member. The inflation member can be an air pump or similar apparatus for filling the air in the inflatable bags. A suitable control unit 170 and sensors 180 can also be used to control the amount of air filled and the pressure created by inflated bags. The control unit allows for selective filling of the inflatable bags.

The inflatable bags provided around the sleeve offers resistance to the free movement of the foot. Thus, the user must apply counterforce to move the foot against the inflated airbags. This counterforce applied by the foot against the resistance offered by the inflated airbags results in the strength-building of the muscles. The resistance provided by the inflated bags can be in all directions, i.e., left, right, front, rear, top, and bottom of the foot within the sleeve. The amount of resistance by the inflatable bags can be varied by using the control unit of the disclosed apparatus. For example, a knob can be provided, wherein the user can turn the knob in either direction to increase or decrease the resistance. Any type of interface that allows the user to modify the settings of the disclosed apparatus is within the scope of the present invention. For example, the interface can have hard buttons and knobs provided on the outside of the housing. The interface can also be provided as an application software on a computing device, such as a smartphone. The control unit can include suitable network circuitry for connecting to an external computing unit, such as a smartphone through a wired or wireless connection.

The user can also selectively change the resistance offered by the inflated bags in different directions. For example, the resistance offered to the left movement of the foot can be more than the resistance to the right movement of the foot. This allows the apparatus to be adapted to the different needs of the user. The user can set the resistance levels based on the workout needs of the foot i.e., based on the strong and weak areas of the foot. This increase in resistance will work the muscles and tendons around the ankle like how one may add weights when performing calf raises or any other exercise.

The inflatable bags around the sleeve can be positioned so that the movement of the foot within the apparatus can be guided and controlled. This allows for safer and more effective exercise. The shape of the inflatable bag can also be such that it stabilizes foot movements preventing any potential injury. For example, inflatable bags can uniformly fit around the foot within the sleeve. The curves of the foot including the arch and plantar can be accommodated by the custom designed inflatable bags that match the profile of a foot.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. An apparatus for foot exercise, the apparatus consists essentially of:

a housing having a bottom wall, a top wall, and sidewalls;

a cutout in the top wall of the housing, the cutout configured to allow a foot of a user to pass through;

a sleeve having a sock-like profile, wherein the sleeve has an opening for receiving the foot of the user, wherein the sleeve is configured to receive at least the foot up to an ankle of the user, wherein a periphery of the opening of the sleeve is coupled to a periphery of the cutout in the top wall, wherein the sleeve hangs within the housing;

a plurality of inflatable bags disposed within the housing and around the sleeve, wherein the plurality of inflatable bags, when inflated, are configured to resist movement of the foot received within the sleeve, wherein the plurality of inflatable bags, when inflated, are configured to allow movement of the foot with some counterforce;

an inflation member configured to inflate the plurality of inflatable bags;

a control unit and sensors operably coupled to the inflation member to control an amount of inflation of the plurality of inflatable bags; and control buttons operably coupled to the control unit.

2. The apparatus of claim 1, wherein the plurality of inflatable bags are configured to resist movement of the foot in left, right, front, rear, top, and bottom directions.

3. The apparatus of claim 1, wherein each inflatable bag of the plurality of inflatable bags is configured to be independently filled with air.

4. The apparatus of claim 3, wherein pressure exerted by each inflatable bag can be controlled.

5. A method for foot exercise, the method comprises:

providing an apparatus, the apparatus consists essentially of:

a housing having a bottom wall, a top wall, and sidewalls, a cutout in the top wall of the housing, the cutout configured to allow a foot of a user to pass through, a sleeve having a sock-like profile, wherein the sleeve has an opening for receiving the foot of the user, wherein the sleeve is configured to receive at least the foot up to an ankle of the user, wherein a periphery of the opening of the sleeve is coupled to a periphery of the cutout in the top wall, wherein the sleeve hangs within the housing, a plurality of inflatable bags disposed within the housing and around the sleeve, wherein the plurality of inflatable bags, when inflated, are configured to resist movement of the foot received within the sleeve, wherein the plurality of inflatable bags, when inflated, are configured to allow movement of the foot with some force, an inflation member configured to inflate the plurality of inflatable bags, a control unit and sensors operably coupled to the inflation member to control an amount of inflation of the plurality of inflatable bags, and control buttons operably coupled to the control unit;

inserting the foot into the sleeve;

upon inserting the foot, inflating the plurality of inflatable bags; and upon inflating, moving the foot against resistance offered by the inflated plurality of inflatable bags.

6. The method of claim 5, wherein the plurality of inflatable bags are configured to resist movement of the foot in left, right, front, rear, top, and bottom directions.

7. The method of claim 5, wherein each inflatable bag of the plurality of inflatable bags is configured to be independently filled with air.

8. The method of claim 7, wherein pressure exerted by each inflatable bag can be controlled, wherein the resistance offered to movement of the foot in a left direction is more than the resistance to movement in a right direction.

9. An apparatus for foot exercise, the apparatus comprises:

a housing having a bottom wall, a top wall, and sidewalls;

a cutout in the top wall of the housing, the cutout configured to allow a foot of a user to pass through;

a sleeve having a sock-like profile, wherein the sleeve has an opening for receiving the foot of the user, wherein the sleeve is configured to receive at least the foot up to an ankle of the user, wherein a periphery of the opening of the sleeve is coupled to a periphery of the cutout in the top wall, wherein the sleeve hangs within the housing; and a plurality of inflatable bags disposed within the housing and around the sleeve, wherein the plurality of inflatable bags, when inflated, are configured to resist movement of the foot received within the sleeve, wherein the plurality of inflatable bags, when inflated, are configured to allow movement of the foot with some force.

10. The apparatus of claim 9, wherein the apparatus further comprises:

an inflation member configured to inflate the plurality of inflatable bags.

11. The apparatus of claim 10, wherein the apparatus further comprises:

a control unit operably coupled to the inflation member to control an amount of inflation of the plurality of inflatable bags.

12. The apparatus of claim 9, wherein each inflatable bag of the plurality of inflatable bags is configured to be independently filled with air.

13. The apparatus of claim 12, wherein pressure exerted by each inflatable bag can be controlled.

* * * * *